US008240302B1

(12) United States Patent
Tayebi et al.

(10) Patent No.: US 8,240,302 B1
(45) Date of Patent: Aug. 14, 2012

(54) BREATHING MASK WITH DEBRIS DEFLECTOR

(76) Inventors: Amad Tayebi, Westford, MA (US); Peter Arsenault, Dracut, MA (US)

( * ) Notice: Subject to any disclaimer, the term of this patent is extended or adjusted under 35 U.S.C. 154(b) by 1090 days.

(21) Appl. No.: 12/214,689

(22) Filed: Jun. 20, 2008

Related U.S. Application Data

(60) Provisional application No. 60/936,503, filed on Jun. 20, 2007, provisional application No. 61/000,319, filed on Oct. 25, 2007.

(51) Int. Cl.
*A62B 18/08* (2006.01)

(52) U.S. Cl. ..... 128/201.15; 128/206.12

(58) Field of Classification Search ..... 128/201.15, 128/201.17, 205.27, 205.29, 206.13, 206.14, 128/206.19, 206.12, 206.23, 206.24
See application file for complete search history.

(56) References Cited

U.S. PATENT DOCUMENTS

| | | | | |
|---|---|---|---|---|
| 2,798,483 | A * | 7/1957 | Kashima | 128/206.15 |
| 5,233,978 | A * | 8/1993 | Callaway | 128/205.25 |
| 5,419,318 | A * | 5/1995 | Tayebi | 128/205.27 |
| 7,017,577 | B2 * | 3/2006 | Matich | 128/206.14 |
| 7,077,137 | B2 * | 7/2006 | Russell | 128/206.12 |
| 7,077,140 | B1 * | 7/2006 | Berke | 128/206.25 |
| 7,243,650 | B2 * | 7/2007 | Thornton | 128/205.25 |
| 7,624,735 | B2 * | 12/2009 | Ho et al. | 128/207.11 |
| 7,836,887 | B1 * | 11/2010 | Kling | 128/206.16 |
| 2002/0026943 | A1 * | 3/2002 | Castiglione | 128/206.19 |
| 2004/0216745 | A1 * | 11/2004 | Yuen et al. | 128/205.27 |
| 2007/0157932 | A1 * | 7/2007 | Cerbini | 128/205.27 |
| 2008/0083411 | A1 * | 4/2008 | Guth | 128/206.12 |
| 2008/0092909 | A1 * | 4/2008 | Hahne | 128/863 |
| 2008/0110465 | A1 * | 5/2008 | Welchel et al. | 128/206.28 |
| 2008/0302365 | A1 * | 12/2008 | Cohen et al. | 128/206.12 |

* cited by examiner

*Primary Examiner* — Allana Lewin
(74) *Attorney, Agent, or Firm* — American Patent Associates; Amad Tayebi

(57) ABSTRACT

A breathing mask with debris deflector features small debris deflectors that close the gaps between the bottom profile of the eyewear worn by the user and the mask face-contacting perimeter. The debris deflectors are positioned, oriented and profiled to prevent fine debris from reaching and harming the eyes of the mask wearer without interfering with the field of vision of the wearer or causing visual glare.

17 Claims, 2 Drawing Sheets

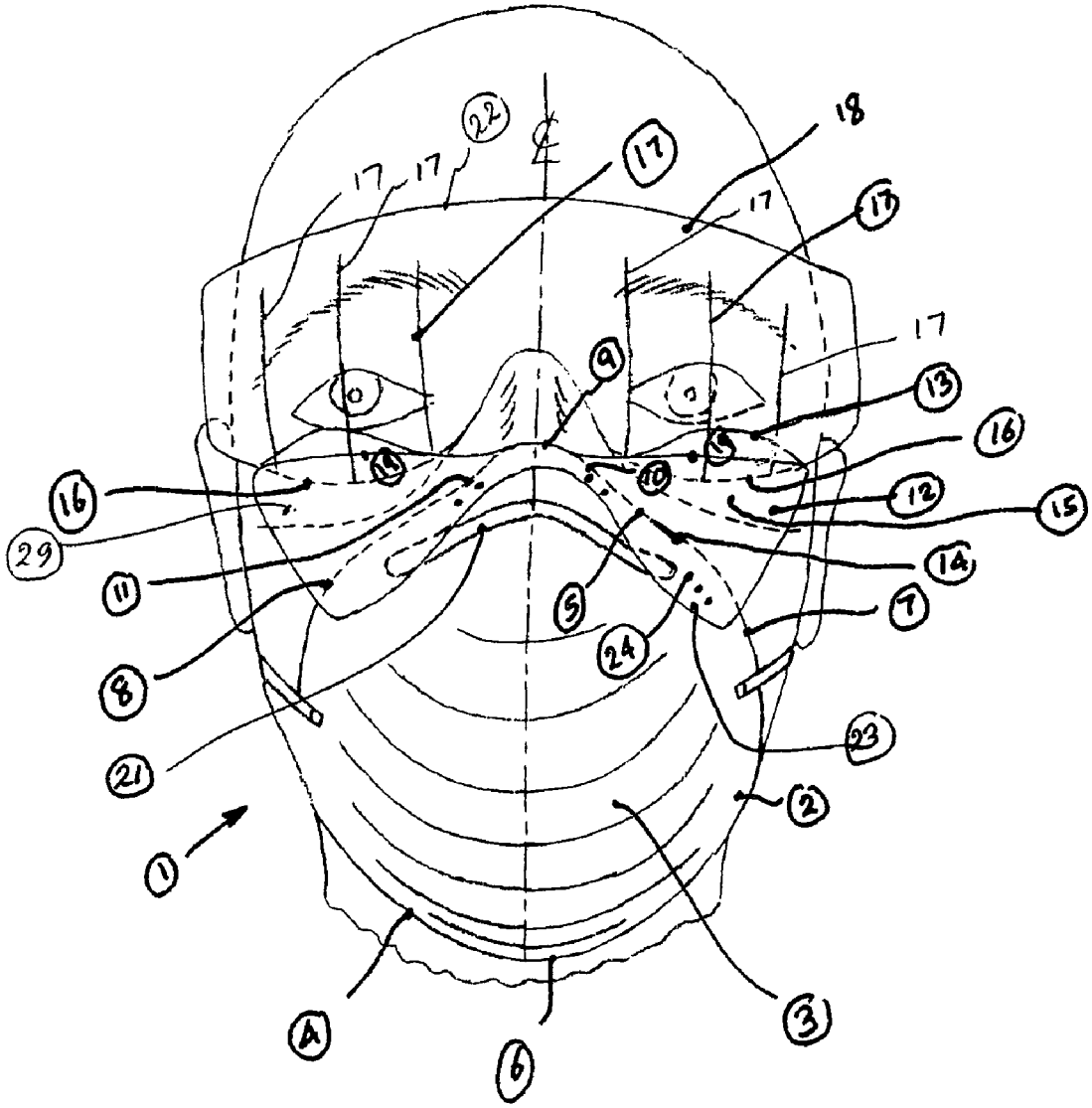
Figure (1)

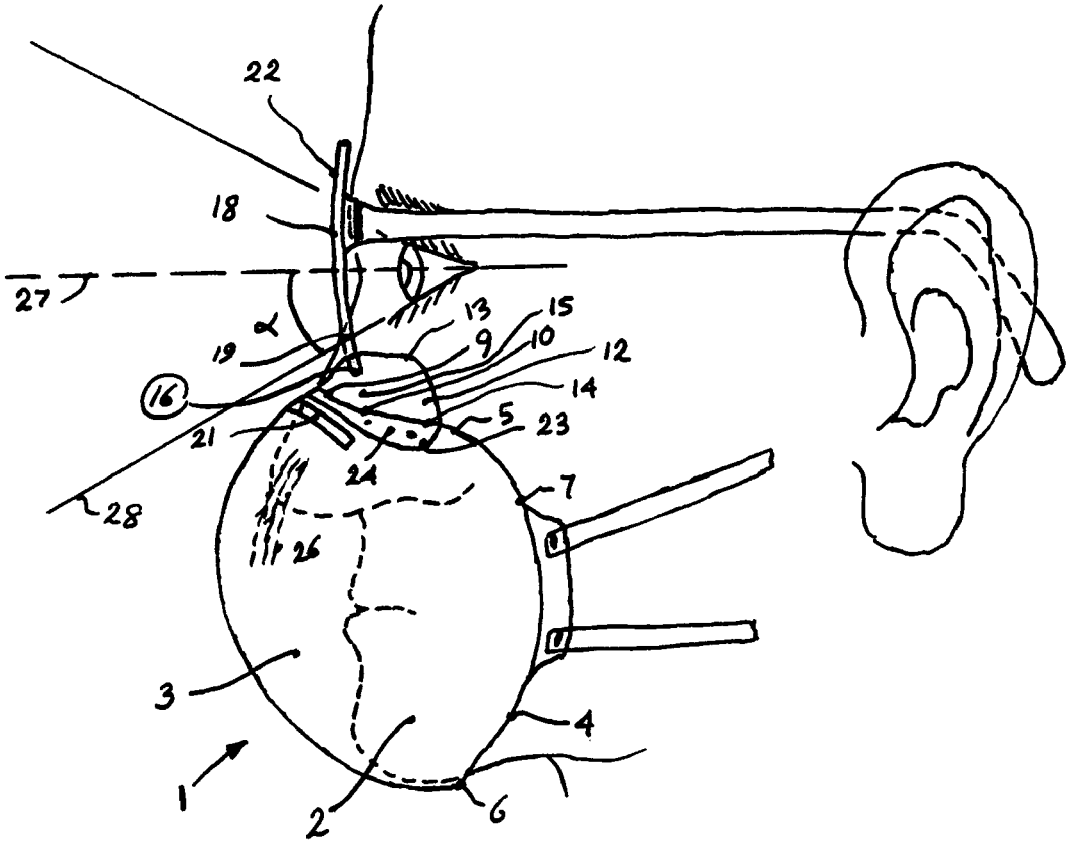
Figure (2)

BREATHING MASK WITH DEBRIS DEFLECTOR

PRIORITY CLAIM

This application claims priority from Provisional Patent Application Ser. No. 60/936,503, filed on Jun. 20, 2007 and Provisional Patent Application Ser. No. 61/000,319, filed on Oct. 25, 2007.

FIELD OF THE INVENTION

The present invention is in the field of protection of the eyes of individuals exposed to particulate debris which may impact and harm their eyes. Professionals that would benefit from using the breathing mask with debris deflector of the present invention include dentists, dental assistants, dental hygienists and other practitioners exposed to air-borne fine-size particulate debris. The mask of the present invention features deflectors positioned to close the gap/opening/unobstructed space between the bottom profile of a protective eyewear (glasses) worn by the wearer of the mask of the present invention and the upper portions (left and right) of the mask and thus deflect air-borne fine-size particles away from the eyes of the mask wearer. Unlike the shields of the prior art, the debris deflector of the present invention does not interfere with the field of vision of the wearer and thus does not cause any glare or visual distortion.

BACK GROUND OF THE INVENTION

Full-face protective shields of the prior art are designed to protect the entire face of the wearer, i.e., from the bottom of the chin to the top of the forehead. Half-face protective shields of the prior art are designed to protect the eyes and forehead of the wearer. Examples of such half-face protective shields are described in U.S. Pat. Nos. 5,020,533, 5,694,925, 5,704,349 and 5,765,556. Each of these patents is hereby incorporated in this disclosure, in its entirety, by reference.

A significant drawback of the half-face protective shields of the prior art is that they are bulky, cumbersome and inconvenient to wear. This is particularly true when the transparent shield is not optically correct and causes visual distortion. These half-face shields also interfere with the use of loops worm by dentists in order to provide them with the necessary magnification of the teeth and gum being examined or worked on.

On the other hand, breathing masks of the prior art featuring transparent optically-correct half-face protective shields provide effective protection of the wearer against debris and splashing fluids. These masks, though presently used by dentists, dental assistants and dental hygienists, do not allow such practitioners to get close to the work area, i.e., to the teeth and gum being examined or worked on. To overcome this limitation, some dentists utilize breathing masks with no protective shields in combination with protective eyewear (glasses), or their prescription glasses. A problem that is encountered with this arrangement is that a gap is unavoidably left open between the bottom profile of the protective eyewear (glasses) worn by the practitioner and the upper portions (left and right) of the mask through which debris can penetrate, impact and harm the dental professional's eye.

The present invention addresses the need to close the above described gap without interfering with the field of vision of the wearer. It also allows the wearer to use loops while not interfering with the wearer's field of vision nor causing any visual distortion.

BRIEF DESCRIPTION OF THE DRAWING

FIG. 1 is a Front View of a molded cup-shaped filtration shell type breathing mask with debris deflector, as worn by a user.

FIG. 2 is a Side View of a molded cup-shaped filtration shell type breathing mask with debris deflector, as worn by a user.

DETAILED DESCRIPTION OF THE INVENTION

The present invention relates to a breathing mask with a debris deflector which is adapted to deflect debris away from the eyes of the wearer of the mask while not interfering with nor being within the field of vision of the breathing mask wearer.

In comparison to protective shields of the prior art, the deflector of the present invention is substantially smaller in size, can be adapted for use with virtually all existing forms of face masks and does not interfere with the field of view (vision) of the wearer. As such, it may be made of clear, tinted, translucent or even opaque thin flexible sheet materials or of thick high impact material such as polycarbonate. As such, it offers the advantage of lower production costs since the deflector sheet material does not have to be optically correct and a much smaller amount of sheet material is used in its construction. Additionally, it eliminates all glare and visual distortion associated with/generated from the use of protective eye shields of the prior art.

In accordance with the present invention, embodiments of which are shown in FIGS. 1 and 2, the breathing mask 1 of the present invention comprises: an air filtration shell 2. The air filtration shell comprises an air filtration element or portion 3 which is surrounded by a face-contacting perimeter 4. The face-contacting perimeter comprises an upper portion 5, a bottom portion 6, a right cheek side area-contacting portion 7 and a left cheek side area-contacting portion 8. The upper portion 5 has a nose bridge-contacting portion 9 and a right segment 10. The right segment contacts the right side of the nose of the wearer and the right cheek upper area of said mask wearer's face. The upper portion 5 also has a left segment 11. Left segment 11 contacts the left side of the nose and the left cheek upper area of the mask wearer's face. Optionally, the upper portion may include a nose clip strip 21, which is typically made of an aluminum strip which is attached to the upper portion 5 or encapsulated within said upper portion. Attached to the filtration shell is a right debris deflector 12. The right debris deflector is preferably made of a thin flexible material and has an upper profile edge 13 and a lower profile edge 14, said thin flexible sheet material being clear, tinted, translucent or opaque. The lower profile edge 14 is attached to the right segment 10, for example, through bottom segment 23 by fastening means 24, e.g., staples, ultrasonic bonding, adhesive, etc. The right debris deflector 12 is shaped to cover the right gap/opening/unobstructed path 15 generated between the bottom profile 16 of a protective eyewear 22 worn by wearer of the mask and the upper portion 5 and/or right cheek side area contacting portion 7. Gap/opening 15 would allow travel of debris behind the viewing lens 18 of protective eyewear 22 towards the eye of the protective eyewear wearer. The right debris deflector is oriented such that its plane intersects generator lines 17 on the protective eyewear right viewing lens 18. Generator lines 17 are imaginary lines, on the eyewear lens, created by the intersection of vertically-oriented planes which are parallel to a horizontal line of sight 27 originating from the pupil of the eye of the eyewear wearer and perpendicular to the face of the eyewear wearer.

Upper edge 13 has a profile extending, outwardly, from the right side of the nose bridge-contacting portion 9, towards the right cheek side area contacting portion 7, and not exceeding the lower line 19 of the field of vision of the wearer, thereby, deflecting air-borne debris, 26 flowing towards right gap 15, away from the wearer's right eye while not interfering with the wearer's field of vision. Lower line 19 is an imaginary line generated by the intersection of a plane 28, oriented at an angle α relative to line of sight 27, as shown in FIG. 2, and the right viewing lens 18. Angle α being within the range of 15° to 75° and preferably within the range of 20° to 40°, and, a left debris deflector 29. Left debris deflector is an identical mirror-image of said right debris deflector 12 and is similarly profiled, oriented and attached.

A significant difference between the mask with debris deflector of the present invention and masks incorporating half-face protective shields of the prior art is that, as worn, the plane of the half-face shield is usually nearly parallel to and surrounds the face of the wearer. In contrast, the debris deflector of the present invention does not even extend to interfere with the field of vision of the mask wearer.

In accordance with the present invention, the right and left debris deflectors 12 and 29, may by made as two separate components and individually attached to their respective right and left segments. Alternatively, they may be made in a monolithic construction, i.e. made as one continuous profiled film.

The debris deflector of the present invention may be attached to the mask shell permanently or detachably. To permanently attach the debris deflector to the mask shell, adhesives, staples, ultrasonic welding, sewing, riveting or other attaching or bonding methods, known in the art, may be used. To detachably attach the debris deflector of the present invention to the mask shell, hook and loop fasteners (commonly known as Velcro® fasteners) may be used. Alternatively, the mask shell may incorporate one end of a snap-fit fastening means while the debris deflectors incorporate the other corresponding snap-fitting ends.

The debris deflector of the present invention may be made of thin flexible material such as polypropylene, polyethylene or polyester film with a thickness in the range of 0.006 to 0.060 inch, or alternatively, of a thick high impact material such as polycarbonate sheet with a thickness in the range of 0.030 to 0.125 inch.

An advantage of detachably attaching the debris deflector is the reduced cost per used mask, especially when the debris deflector is made of a thick high impact material and is detached from the used mask, washed and reattached to a new mask.

Further, in accordance with the present invention, the air filtration shell 2 of breathing mask 1 may be in the form of i) a pleated filtration shell, for example, as described in U.S. Pat. Nos. 4,606,341, 4,635,628, 4,802,473, 4,941,470, 4,969,457, 5,020,533, 5,553,608, 5,694,925, 5,699,792, 5,704,349, and 5,813,398, and in U.S. Patent Application Publication No. US 2004/0000313, ii) a duck-bill-shaped filtration shell, for example, as described in U.S. Pat. Nos. 5,322,061, 5,724,964, 5,765,556, Des. 347,090 and Des. 347,713, iii) a molded-cup-shaped filtration shell or a molded-cup-shaped foam facepiece comprising a filtration element, for example, as described in U.S. Pat. Nos. 5,419,318, 4,641,645, 5,673,690, 4,856,508, 4,945,907, 5,080,094, 5,094,236 and 6,102,040 or iv) a folded filtration to shell, as provided in the prior art and is commercially available from a variety of suppliers. Each of said U.S. patents and Patent Application Publication is, hereby incorporated, by reference, in its entirety, in this application.

The invention claimed is:

1. A breathing mask with debris deflector comprising;

an air filtration shell, said air filtration shell comprising an air filtration portion surrounded by a face-contacting perimeter, said face-contacting perimeter comprising an upper portion, a bottom portion, a right cheek side area-contacting portion and a left cheek side area-contacting portion, said upper portion having a nose bridge-contacting portion, a right segment, said right segment contacting the right side of the nose of the wearer of said breathing mask and the right cheek upper area of said wearer's face, a left segment, said left segment contacting the left side of the nose of the wearer of said breathing mask and the left cheek upper area of said wearer's face, a right debris deflector, said right debris deflector having an upper profile edge and a lower profile edge, said lower profile edge being attached to said right segment by fastening means, said right debris deflector being shaped to cover the right gap generated between the right bottom profile of a protective eyewear that may be worn by said wearer of said breathing mask and at least one of said upper portion and right cheek side area-contacting portion, said gap allowing travel of debris behind the right viewing lens of said protective eyewear towards the right eye of said wearer of said protective eyewear, said right debris deflector being oriented such that its plane intersects generator lines on said protective eyewear viewing lenses, said generator lines being imaginary lines, on said protective eyewear viewing lenses, created by the intersection of imaginary vertically-oriented planes which are parallel to a horizontal line of sight originating from the pupil of the eye of said protective eyewear wearer and perpendicular to the face of said protective eyewear wearer, and the viewing lenses of said protective eyewear, said upper profile edge having a profile enabling said right debris deflector to cover said right gap and extending, outwardly, from the right side of said nose bridge-contacting portion towards said right cheek side area contacting portion but not above the lower line of the field of vision of said wearer, thereby, deflecting air-borne debris, traveling towards said right gap, away from the wearer's right eye while not interfering with said wearer's field of vision, said lower line of the field of vision of said wearer being generated by the intersection of an inclined plane, oriented at an angle α relative to said horizontal line of sight, and said right viewing lens, said angle α being within the range of 15° to 75°, and, a left debris deflector, said left debris deflector being an identical mirror-image of said right debris deflector and similarly profiled, oriented and attached.

2. The breathing mask with debris deflector according to claim 1, wherein said mask further comprising a nose clip strip, said nose clip strip being externally attached to said upper portion.

3. The breathing mask with debris deflector according to claim 1, wherein said mask further comprising a nose clip strip, said nose clip strip to being encapsulated within said upper portion.

4. The breathing mask with debris deflector according to claim 1, wherein said right and said left debris deflectors being made of a flexible material.

5. The breathing mask with debris deflector according to claim 1, wherein said right and said left debris deflectors being made of a high impact material.

6. The breathing mask with debris deflector according to claim 1, wherein said right and said left debris deflectors being made of a transparent material.

7. The breathing mask with debris deflector according to claim 1, wherein said right and said left debris deflectors being made of an opaque material.

8. The breathing mask with debris deflector according to claim 1, wherein said right and said left debris deflectors being made of a translucent material.

9. The breathing mask with debris deflector according to claim 1, wherein said lower profile edge being attached to said right segment through a connecting bottom segment, said connecting bottom segment being attached to said right segment by fastening means.

10. The breathing mask with debris deflector according to claim 1, wherein said right debris deflector and said left debris deflector being detachably attached to said right segment and said left segment, respectively.

11. The breathing mask with debris deflector according to claim 1, wherein said right debris deflector and said left debris deflector being made in a monolithic construction.

12. The breathing mask with debris deflector according to claim 1, wherein said right debris deflector and said left debris deflector being made as two separate components and individually attached to their respective right and left segments.

13. The breathing mask with debris deflector according to claim 1, wherein said angle $\alpha$ being in the range of 20° to 40°.

14. The breathing mask with debris deflector according to claim 1, wherein said air filtration shell being in the form of a pleated filtration shell.

15. The breathing mask with debris deflector according to claim 1, wherein said air filtration shell being in the form of a duck-bill-shaped filtration shell.

16. The breathing mask with debris deflector according to claim 1, wherein said air filtration shell being in the form of a molded-cup-shaped filtration shell.

17. The breathing mask with debris deflector according to claim 1, wherein said air filtration shell being in the form of a folded filtration shell.

* * * * *